US008297362B1

(12) United States Patent
Strider et al.

(10) Patent No.: US 8,297,362 B1
(45) Date of Patent: Oct. 30, 2012

(54) NATURAL GAS SUPPLY APPARATUS AND METHOD

(75) Inventors: Larry K. Strider, Chelsea, AL (US); Brennan K. Wyatt, Cottondale, AL (US); David C. Hayworth, Jr., Northport, AL (US)

(73) Assignee: HighMount Exploration & Production LLC, Houston, TX (US)

( * ) Notice: Subject to any disclaimer, the term of this patent is extended or adjusted under 35 U.S.C. 154(b) by 134 days.

(21) Appl. No.: 12/326,586

(22) Filed: Dec. 2, 2008

(51) Int. Cl.
*E21B 43/00* (2006.01)
*F04B 23/08* (2006.01)

(52) U.S. Cl. ..... 166/369; 166/373; 166/68.5; 166/72; 166/75.12; 417/199.1

(58) Field of Classification Search ..... 166/369, 166/373, 68, 68.5, 72, 75.12; 417/199.1
See application file for complete search history.

(56) References Cited

U.S. PATENT DOCUMENTS 3,247,798 A * 4/1966 Glasgow et al. ..... 166/68.5
4,380,150 A 4/1983 Carlson
4,466,301 A 8/1984 Hill
4,492,126 A 1/1985 David
4,501,119 A * 2/1985 Stanton ..... 60/398
4,530,646 A 7/1985 McCoy
5,290,156 A * 3/1994 Mayland ..... 417/415
6,305,918 B2 10/2001 Turiansky
6,422,313 B1 7/2002 Knight
6,572,116 B2 * 6/2003 Turiansky ..... 277/436
7,717,082 B2 * 5/2010 Mullin ..... 123/196 R
7,730,939 B2 * 6/2010 Merrick, III ..... 166/105
8,047,820 B2 * 11/2011 Merrick, III ..... 417/555.1
2009/0107267 A1 * 4/2009 Mullin ..... 74/41
2010/0054959 A1 * 3/2010 Rogers et al. ..... 417/53

OTHER PUBLICATIONS

George Sly, Jr., How to Boost Gas Yield from Marginal Oil Wells, Petroleum Engineer, Aug. 1974, pp. 65,66 and68.
Manual, EN.Series, Aug. 28, 2008—download from web site AirCylindersDirect.com.
Manual, Humphrey Technical Manual: SQE1, SQE2, QE2, QE3, QE4, QE5, SQE Quick Exhaust, Apr. 10, 2006, pp. 192-194.
Ali M. Al-Khatib, SPE, Improving Oil and Gas Production with the Beam-Mounted Gas Compressor, Journal of Petroleum Technology, Feb. 1984, pp. 276-280.
Charles McCoy, Beam-operated Gas Compressor is Profitable in Various Field Applications, World Oil Magazine, Sep. 2003.

* cited by examiner

*Primary Examiner* — Jennifer H Gay
(74) *Attorney, Agent, or Firm* — McAfee & Taft

(57) ABSTRACT

An apparatus and method for supplying natural gas from a well operating under vacuum conditions by extracting, storing and communicating it to a natural gas-fired piece of oil field equipment is provided. The apparatus has a pump associated with a pump jack for extracting natural gas. The apparatus communicates natural gas to a volume tank and stores it until it needed by a natural gas-fired piece of oil field equipment.

17 Claims, 6 Drawing Sheets

NATURAL GAS SUPPLY APPARATUS AND METHOD

BACKGROUND

The present disclosure is directed to an apparatus and method for extracting and communicating natural gas from gas wells, for example those operating under vacuum conditions, to a natural gas-fired piece of oil field equipment.

A pump jack (also known as a nodding donkey, pump unit, horsehead pump, beam pump, sucker rod pump, grasshopper pump, thirsty bird and jack pump) is often used to assist in the production of natural gas from low pressure wells by pumping liquid from the wellbore so that natural gas is able to flow from the well. Pump jacks are commonly driven by motors, or engines, which are commonly referred to as prime movers and may run on electricity, diesel, propane or natural gas. Due to their proximity to the well and the inherent difficulty in servicing many well sites, a large number of prime movers operate on natural gas supplied directly from the well. Unfortunately, natural gas-fired prime movers cease to operate when the pressure in a well, or gas supply line, develops a negative pressure or drops to such a low pressure level that it cannot supply natural gas to the prime mover.

As reservoir pressure drops, natural gas production from wells accessing the reservoir decreases. Liquid build up in natural gas wells also causes gas production to drop. When there is not a sufficient level of natural gas provided to a natural gas-fired prime mover due to low pressure in the well, the prime mover and pump jack cease to operate. This situation requires a manual restart of the prime mover, if possible, which may take days or weeks. The resulting fluid build up in the well frequently kills all production of natural gas from the well.

In a large field of natural gas wells, many wells are put under a vacuum to assist in the extraction of gas to be supplied to a gas supply line. When a well, or a field of wells, cease to produce gas without assistance, a compressor may be used to create a vacuum on the well to supply gas to a gas supply line. Whenever a vacuum is drawn on the well, there is usually an insufficient level of gas pressure available to provide fuel for the natural gas-fired prime mover. The vacuum on the well makes the use of a natural gas prime mover impractical or impossible without providing another fuel source.

The foregoing issues show there is a need for an apparatus to provide a consistent supply of natural gas to a prime mover for uninterrupted operations.

SUMMARY OF THE INVENTION

The current disclosure is directed to a device and method to supply natural gas to a prime mover which drives a pump jack. An adjustable bracket is also disclosed. The disclosure also provides for a method to install the adjustable bracket for connecting the device to the pump jack.

In a first aspect, the apparatus comprises a volume tank and a natural gas-fired prime mover. The volume tank receives natural gas from a natural gas well. The volume tank provides the natural gas to the prime mover which is used to drive a pump jack.

In another aspect, the apparatus comprises a pump, a volume tank and a natural gas-fired prime mover. The pump is used for extracting the natural gas from a natural gas well. The volume tank is adapted to receive the natural gas from the pump. The prime mover is positioned to receive and operate on natural gas communicated from the volume tank and is adapted to drive the pump jack.

In yet another aspect, the apparatus comprises a pump jack, a pump, a volume tank and a prime mover. The pump is used for extracting the natural gas from the natural gas well. The pump has a piston adapted to provide compression of the extracted natural gas. The piston is movably attached to the pump jack. The volume tank receives the natural gas communicated from the pump, and the volume tank communicates natural gas to the prime mover, which drives the pump jack.

In still another aspect, an adjustable bracket comprises an anchor channel, a clamping channel, a plurality of thread rods, and a set of securing devices. The adjustable bracket connects the pump to a beam. The anchor channel has a mounting flange with a plurality of holes disposed in an interior edge. The clamping channel has a securing block with a plurality of holes disposed therethrough. The plurality of holes disposed through the clamping channel are equal in number to the plurality of holes disposed in the mounting flange. The plurality of threaded rods are adapted to be disposed in the plurality of holes in the anchor channel, and adapted to be disposed through the plurality of holes in the securing block. The set of securing devices are for securing the anchor channel, clamping channel and plurality of threaded rods to each other.

In another aspect, a method to install an adjustable bracket for connecting a pump to a pump jack is disclosed and comprises the following steps:

(a) placing the adjustable bracket on the walking beam of the pump jack;

(b) connecting a first end of the pump to the adjustable bracket;

(c) sliding the adjustable bracket along the walking beam until the pump is positioned to be able to complete a full stroke of a piston operably associated with the pump; and (d) securing the adjustable bracket to the walking beam.

In another aspect, a method for operating a pump jack is disclosed and comprises the following steps:

(a) extracting natural gas from a well;

(b) communicating the natural gas to a tank;

(c) communicating the natural gas from the tank to a prime mover; and (d) driving the pump jack with the prime mover.

The objects, features and advantages of the present invention will be readily apparent to those skilled in the art upon reading the description of the preferred embodiments which follow when taken in conjunction with the accompanying drawings.

BRIEF DESCRIPTION OF THE DRAWINGS

FIG. 6 is an exploded perspective view of the adjustable bracket.

DETAILED DESCRIPTION

Figure 1:
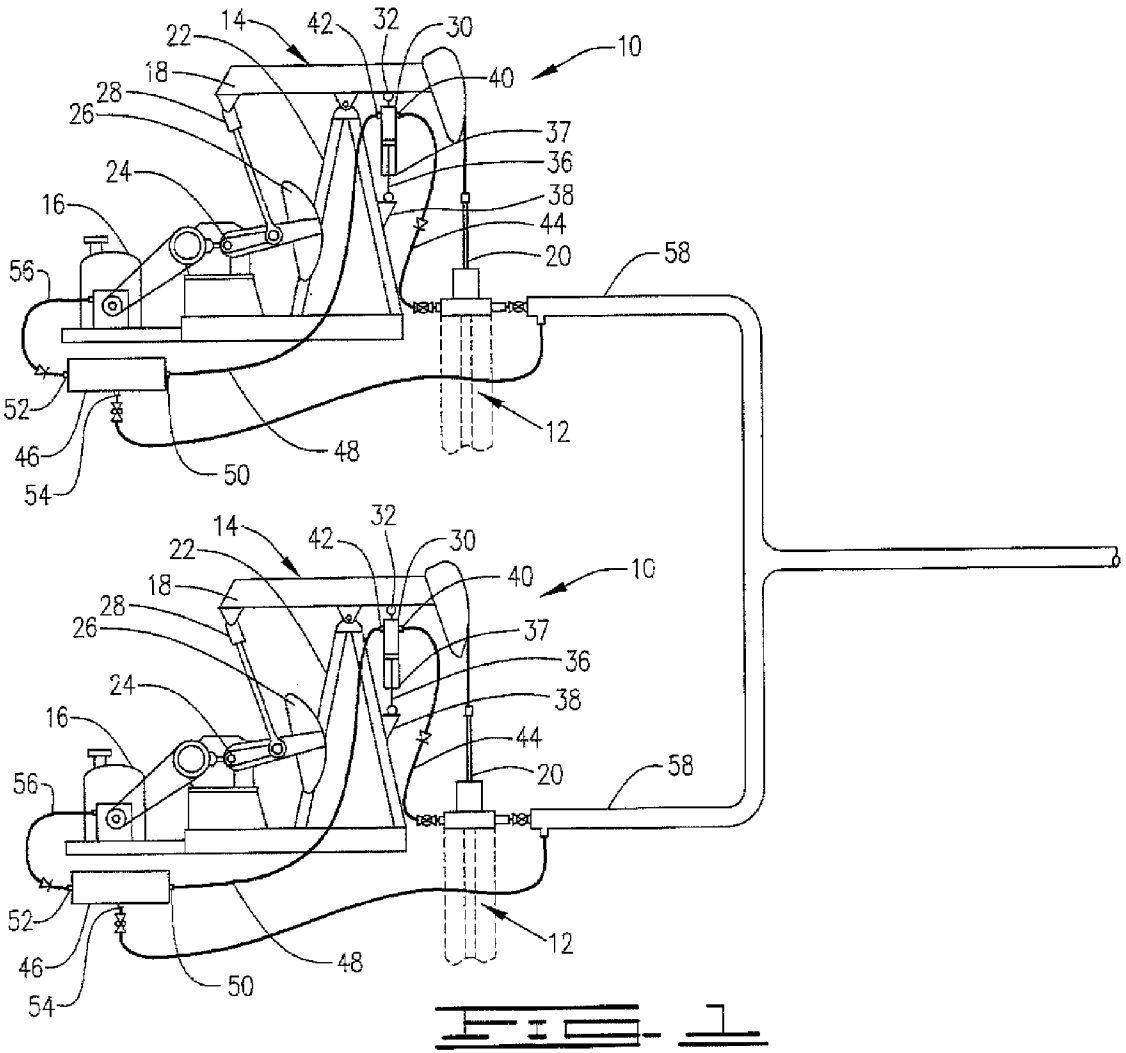
FIG. 1 is a schematic of two pump jacks with pumps connected thereon and incorporated as part of a producing natural gas field.
Figure 2:
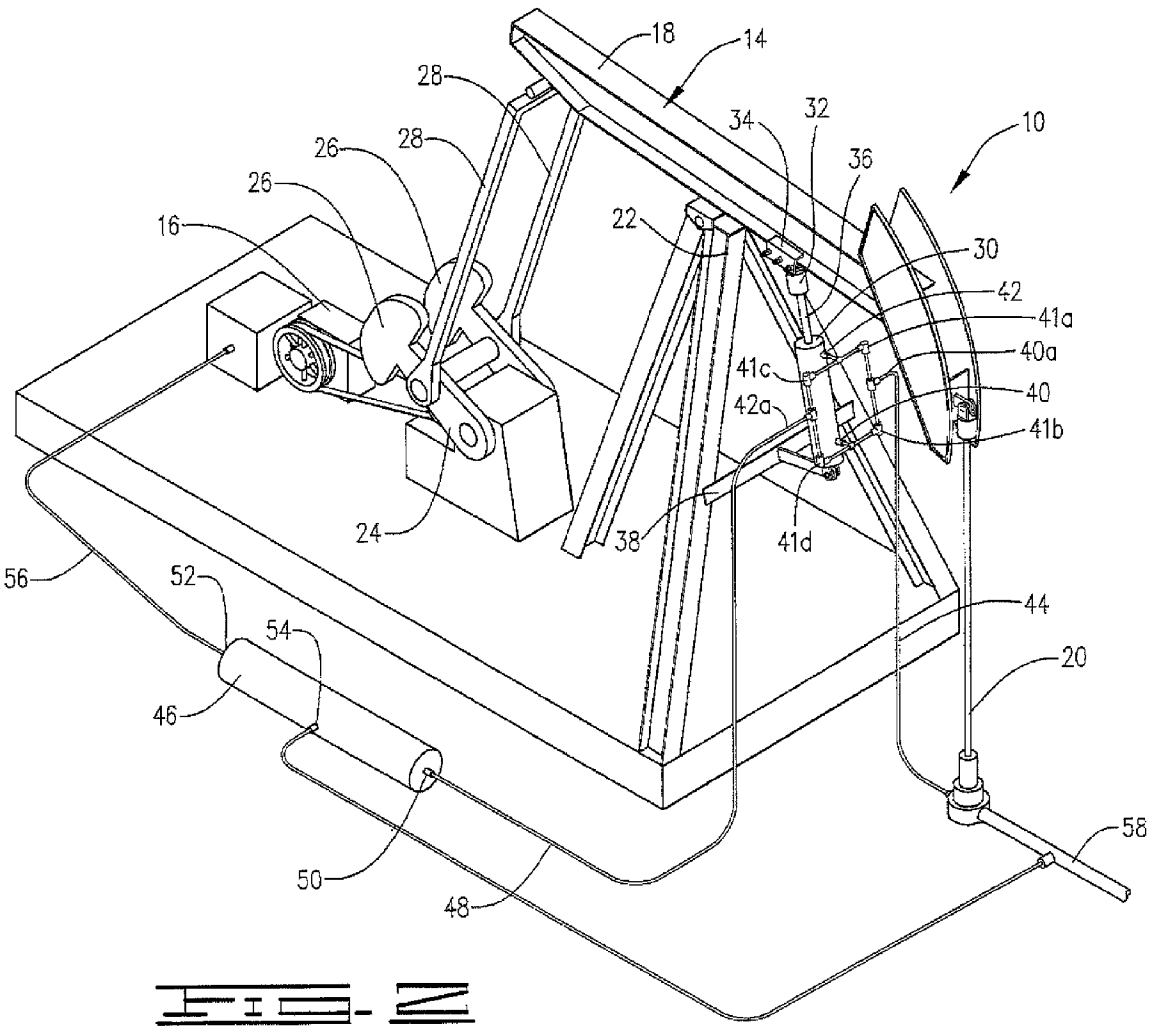
FIG. 2 is a perspective view of a pump jack positioned on a well, with the pump jack being driven by a prime mover, and having the pump and volume tank installed thereon.

Referring to the drawings and more particularly to FIGS. 1 and 2, the natural gas supply apparatus of the current disclosure is illustrated and generally designated by the numeral 10. As shown by the drawings and understood by those skilled in the art, natural gas supply apparatus 10 and components thereof are particularly well adapted to extract natural gas from well 12. FIGS. 1 and 2 have been greatly simplified to eliminate much of the piping and wiring associated with natural gas supply apparatus 10. The omitted items are known in the art, and are not necessary for an understanding of the invention.

Natural gas supply apparatus 10 is shown in FIGS. 1 and 2 connected to pump jack 14, which is driven by prime mover 16. A representative example of pump jack 14 is depicted in FIGS. 1 and 2, and is used to describe the natural gas supply apparatus 10. Other variations of pump jacks known to those skilled in the art will also work with natural gas supply apparatus 10.

FIG. 2 shows pump jack 14 positioned so that the reciprocal pivoting motion of walking beam 18 moves polish rod 20 in and out of well 12. Walking beam 18 is positioned on top of Samson post 22. Typically, prime mover 16 provides input to turn crank 24 which is connected to counter weight 26. Counter weight 26 is connected to walking beam 18 by pitman arm 28. The reciprocal pivoting motion of walking beam 18 is driven by the input from prime mover 16.

In one embodiment, natural gas supply apparatus 10 comprises pump 30 and volume tank 46. Pump 30 is shown in FIGS. 1 and 2 as being positioned between walking beam 18 and Samson post 22. Pump 30 is a piston driven pump that creates a vacuum on well 12 to extract gas therefrom. Pump 30 shown in FIG. 3 has one lug mount 32 positioned on piston 36, and another lug mount 32 positioned on opposite end 37. Lug mount 32 provides a mount point for pump 30 for attachment to pump jack 14. Lug mount 32 is a representative example of the variety of mounting devices available for mounting pump 30.

Figure 3:
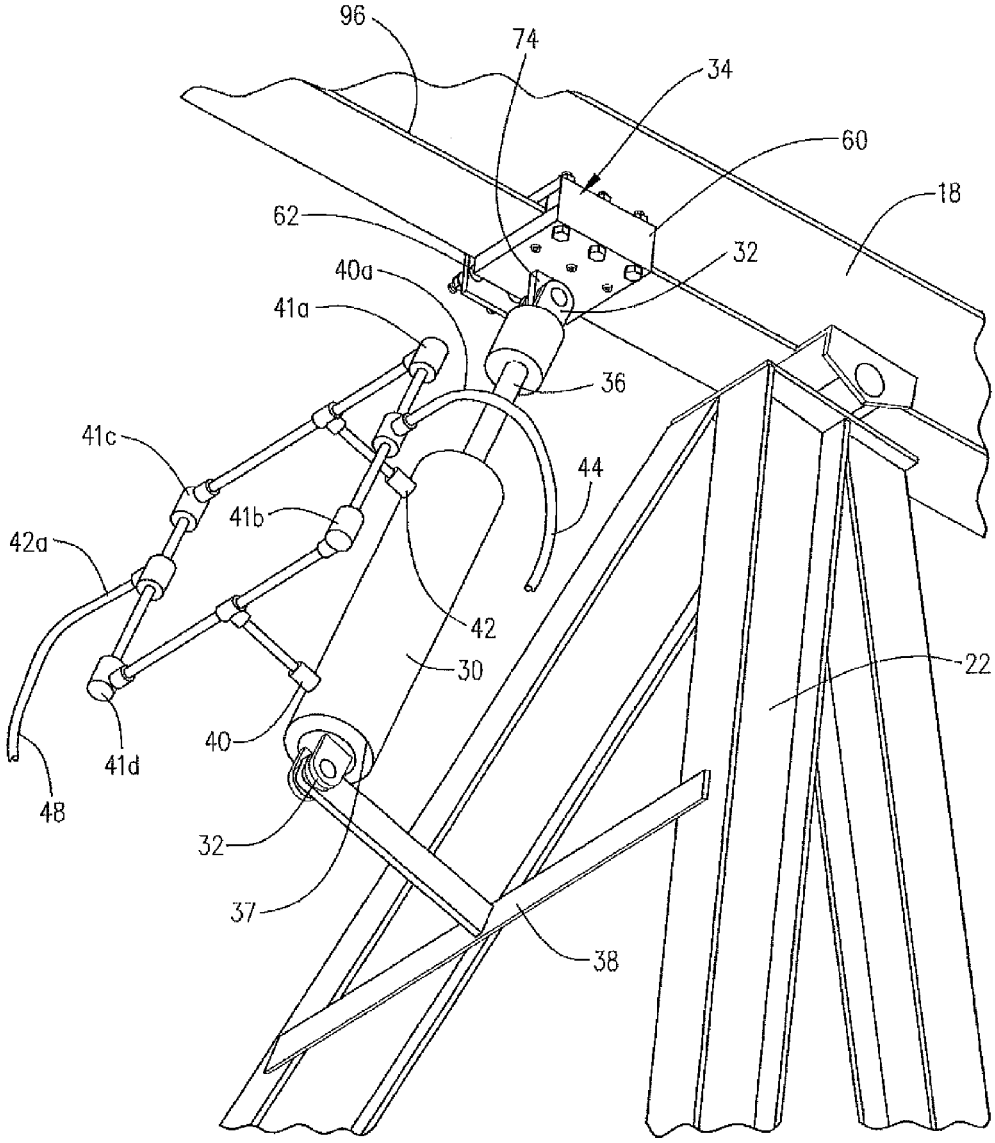
FIG. 3 is a bottom perspective view of an adjustable bracket installed on a pump jack.

Continuing to refer to FIG. 3, adjustable bracket 34 is shown positioned on walking beam 18, and sliding bracket 38 is shown positioned on Samson post 22. Adjustable bracket 34 provides a mounting point for lug mount 32 on piston 36, and sliding bracket 38 provides a mounting point for lug mount 32 on opposite end 37. Both adjustable bracket 34 and sliding bracket 38 are adapted for moving during installation of pump 30. Additionally, pump 30 may be easily inverted to have piston 36 attached to sliding bracket 38.

Pump 30 has gas inlet 40 for receiving gas from well 12, and gas outlet 42 for directing gas to volume tank 46. As shown in FIGS. 2 and 3, gas input line 44 provides a fluid connection and communication between gas inlet 40 and well 12, while gas outlet line 48 provides fluid connection and communication between gas outlet 42 and volume tank 46.

Pump 30 may be any pump capable of creating a lower pressure on well 12 such that natural gas is extracted and communicated to pump 30. A preferred double acting pump is shown in FIGS. 2 and 3. Both gas inlet 40 and gas outlet 42 perform the inlet and outlet function when they are used with the preferred double acting pump air cylinder. As shown in FIGS. 2 and 3, gas inlet 40 and gas outlet 42 both apply suction on gas inlet feed 40*a*, which connects to upper and lower quick exhaust valves 41*a* and 41*b*. The preferred double acting pump also exhausts gas through gas inlet 40 and gas outlet 42, thereby pressurizing gas into gas outlet feed 42*a* via a second set of upper and lower quick exhaust valves 41*c* and 41*d*. Quick exhaust valves 41*a-d* are commercially available shuttle valves. Using a double acting pump allows pump 30 to apply suction and exhaust gas on both the up and down strokes of piston 36. As shown in FIGS. 2 and 3, gas inlet feed 40*a* receives gas from gas input line 44 and gas outlet feed 42*a* provides gas to outlet line 48.

An example of the preferred pump 30 presented in FIGS. 2 and 3 may be an ENS.Series air cylinder having either a five (5) or six (6) inch bore. The ENS.Series air cylinder is available from www.aircylindersdirect.com. Additionally, the example quick exhaust valves 41*a-d* that may be used are Humphrey® QE3 or QE4 Super Quick Exhaust Valves. Other models of pump 30 by different manufacturers are also used, and may have larger or smaller bores. The Humphrey® Super Quick Exhaust Valves in the example are replaceable by other manufacturers' check valves.

Volume tank 46 has tank gas input 50, primary gas output 52, and overflow gas output 54. Tank gas input 50 is adapted to receive gas from gas output line 48. Alternatively, volume tank 46 is adapted to receive natural gas directly from well 12, or from gas supply line 58. Primary gas output 52 is in fluid communication with prime mover 16. Referring to FIG. 2, primary gas line 56 connects primary gas output 52 with prime mover 16. Other gas-fired equipment may be attached to volume tank 46 as long as positive pressure is maintained in volume tank 46.

Tank gas input 50 is preferably a one-way valve allowing gas to enter volume tank 46. Primary gas output 52 is preferably a one-way valve allowing gas to exit volume tank 46. Overflow gas output 54 is preferably a pressure relief valve set to release gas from volume tank 46 when the gas reaches a pre-determined pressure level as described below. Overflow gas output 54 is in fluid communication with a gas supply line 58, which is ultimately communicated to a gas sales line.

In a normal operations cycle, it is common for prime mover 16 to start, warm-up and operate pump jack 14 for a period of time. This period of time may be intermittent, or it may be until there is no more gas to extract from well 12. For intermittent operations, prime mover 16 drives pump jack 14 until the liquid level is lowered to a desired level, whereby prime mover 16 is turned off and/or on stand-by for the next operations cycle. Thus, volume tank 46 is sized to have enough gas in a sufficient volume such that prime mover 16 is able to at least start, and in some cases, warm-up and begin operating pump jack 14, while always maintaining a positive pressure within volume tank 46. Once pump jack 14 begins operating, pump 30 begins to replenish volume tank 46, so that the supply of gas from volume tank 46 being communicated to to prime mover 16 is sufficient to continue operating pump jack 14 for the desired time, whether that time is a defined period or a continuous operation. The sizing of volume tank 46 and the pre-determined pressure level of overflow gas output 54 is dependent upon the particular prime mover utilized. The volume of gas in volume tank 46 is always maintained at a positive pressure. For a larger prime mover 16, volume tank 46 will need to be larger, or contain a larger pressure volume of gas.

For a continuously operating prime mover 16, prime mover 16 drives pump jack 14 until there is insufficient gas in well 12 to extract, or until prime mover 16 is manually stopped. Excess gas in volume tank 46 is removed through overflow gas output 54. In the embodiment described, once prime mover 16 starts, it will begin operating pump jack 14, which will operate pump 30 so that natural gas is extracted from well 12 and delivered to prime mover 16 through volume tank 46. In some cases, the prime movers may employ a system (not shown) to engage/disengage a drive mechanism providing input to crank 24. In this situation, volume tank 46 is sized to have sufficient gas to provide for the startup, warm-up and cyclical engagement/disengagement of the drive mechanism providing input to crank 24:

A typical oil field worker can easily calculate what is a sufficient volume of gas in volume tank 46 by knowing the total volume of gas, the pressure of the gas at startup, the fuel gas requirements of prime mover 16, and the time period required to produce a sufficient flow of gas from well 12 to replenish the gas being consumed by prime mover 16. For intermittent operations of prime mover 16, the fuel gas requirements of prime mover 16 include startup, warm-up in some systems, and the time to operate pump jack 14 until enough gas is communicated to volume tank 46 to replenish volume tank 46 so that any necessary startup, warm-up and operation can be repeated. The foregoing information provides sufficient information for the oil field worker to properly size volume tank 46 and to calculate the pre-determined pressure of overflow gas output 54.

One element in determining the period of time required to replenish the natural gas in volume tank 46 requires knowing how much gas a prime mover 16 burns. Prime mover 16 burns a volume of natural gas, measured in cubic feet of natural gas per hour. For example, a small prime mover 16 may burn about 0.1 mcf of natural gas per hour, and a larger prime mover 16 may burn about 0.2 mcf of natural gas per hour. Thus, for repeated intermittent operations, volume tank 46 must have enough natural gas so that prime mover 16 is able to operate through startup, warm-up, and if necessary, operate for an additional period of time to replenish the volume of gas in volume tank 46. An example of a desired period of time may be as little as about five (5) minutes, or as much as 30 minutes. If prime mover 16 is not a continuously operating prime mover 16, prime mover 16 can be shutoff once volume tank 46 has a sufficient volume of gas to repeat the startup procedure.

By way of an example, natural gas supply apparatus 10 uses a 13 horsepower prime mover 16 and has a volume tank 46 with a starting volume of about 1.5 cubic feet of natural gas at a pressure level of about 40 pounds per square inch prior to startup. Preferably, prior to the first use of volume tank 46 with pump 30, volume tank 46 is filled from another source of natural gas. The natural gas pressure is at least equal to or less than the pre-determined level of pressure that is set for overflow gas output 54. Once prime mover 16 is started, natural gas in volume tank 46 rapidly burns, thus decreasing the volume and pressure within volume tank 46. The input to pump jack 14 causes pump 30 to start pumping and extracting natural gas from well 12. Pump 30 communicates natural gas to volume tank 46, increasing the pressure to a level equal to pressure of overflow gas output 54.

As discussed herein, pump 30 is attached to walking beam 18 with adjustable bracket 34. Adjustable bracket 34 is adapted to allow movement of pump 30 during setup to maximize the stroke length of piston 36. As shown in FIG. 3, adjustable bracket 34 is designed to be mounted on a beam with two parallel flanges, such as an I-beam or parallel flange 96 of walking beam 18.

Adjustable bracket 34 includes anchor channel 60 and clamping bracket 62. Anchor channel 60 comprises mounting flange 64, anchor flange 66 and spacer block 68. Mounting flange 64 and anchor flange 66 are separated by spacer block 68. Mounting flange 64 has mounting side 70 and beam side 72. Mounting side 70 has mounting fixture 74 affixed. As shown in FIG. 3, mounting fixture 74 is adapted to receive lug mount 32 on piston 36. However, any mounting fixture used on pump 30 and piston 36 will have a compatible mounting fixture 74 on mounting side 70.

Figure 4:
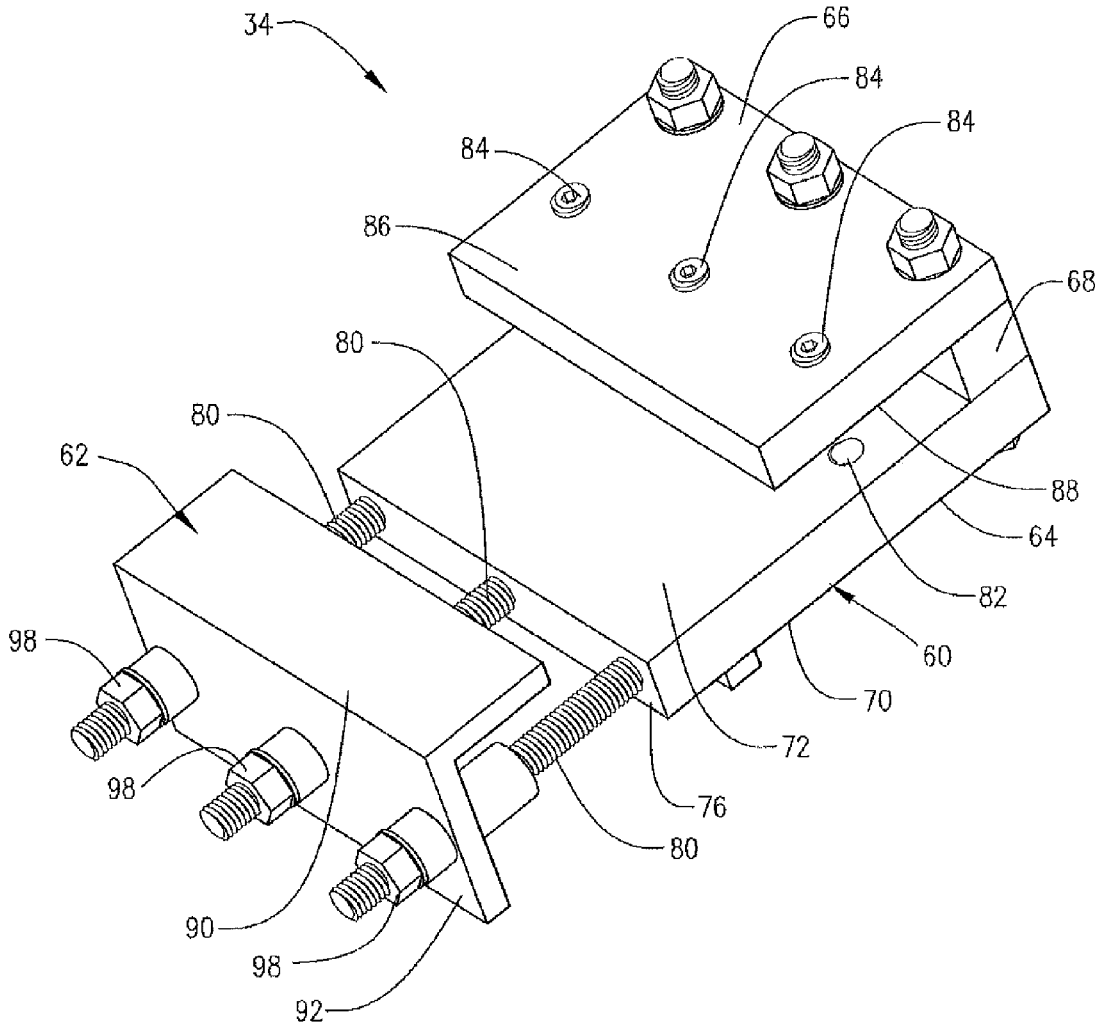
FIG. 4 is a top perspective view of the adjustable bracket.
Figure 5:
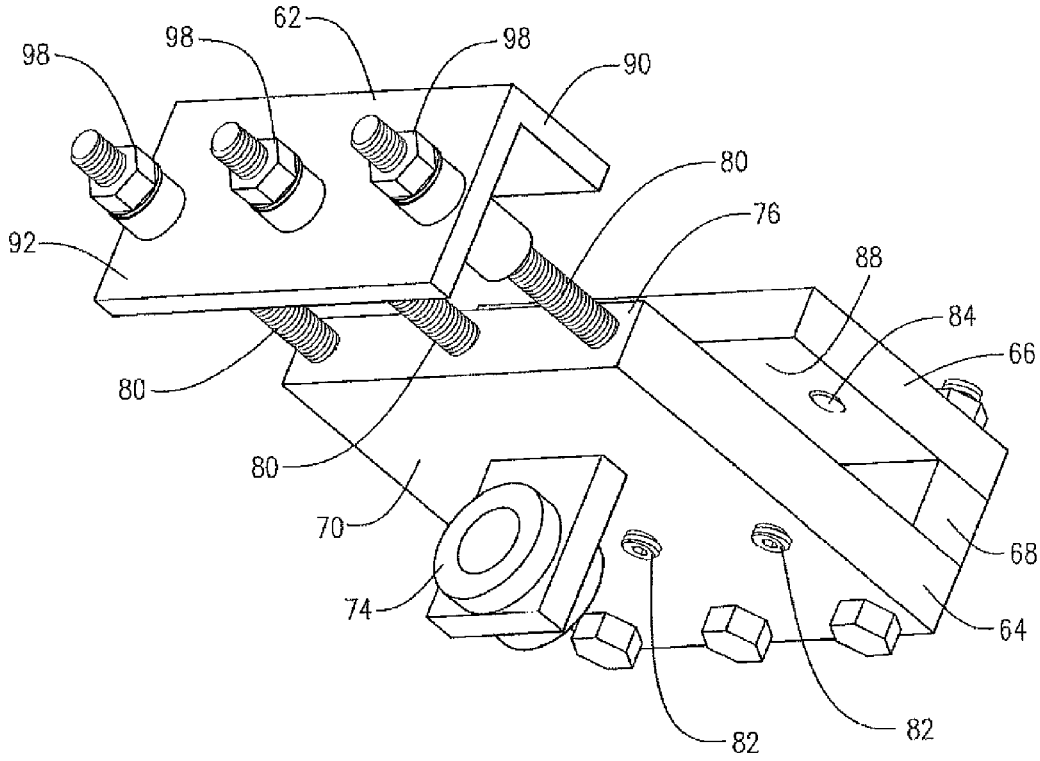
FIG. 5 is a bottom perspective view of the adjustable bracket.
Figure 5:
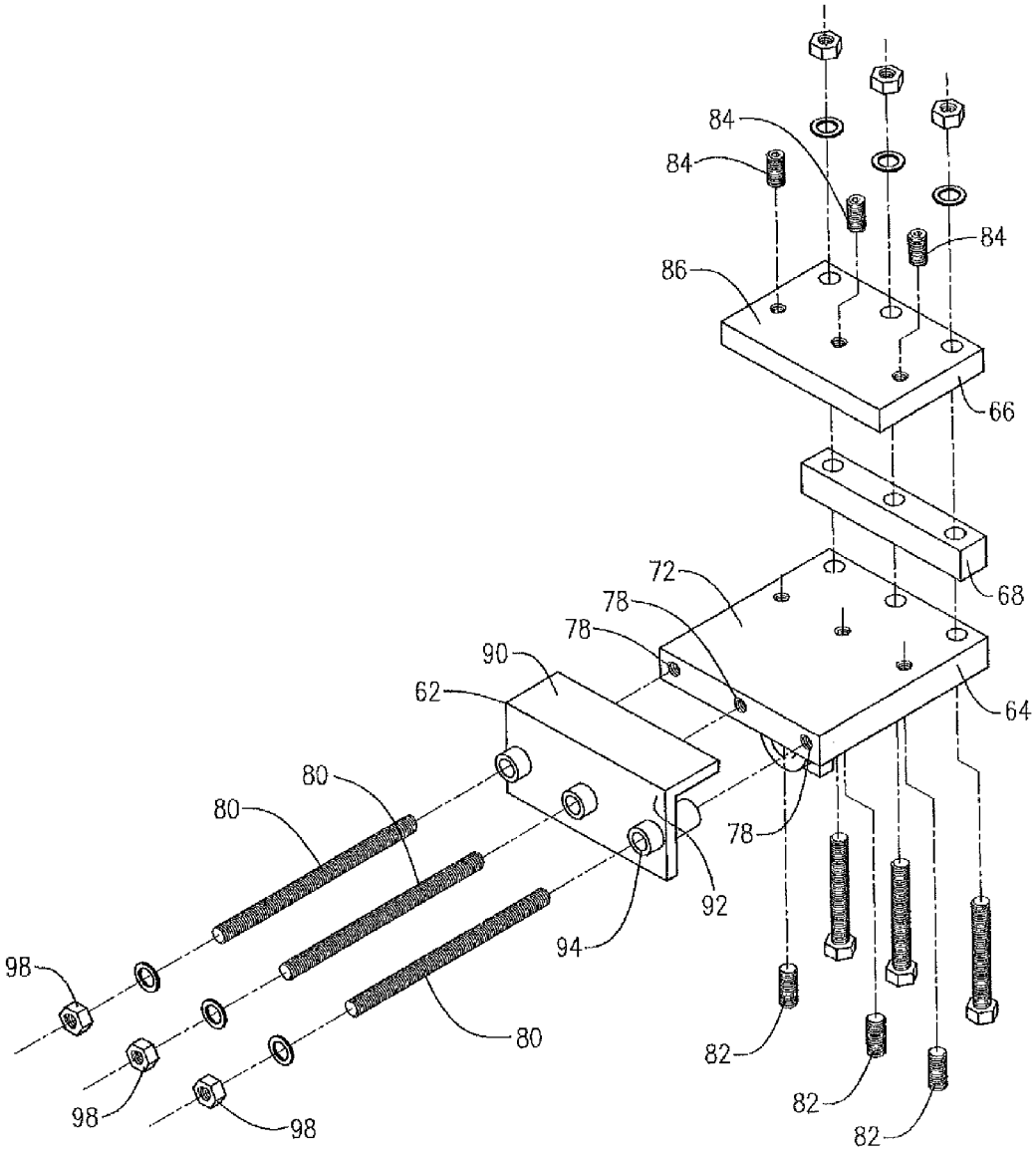

Mounting flange 64 has interior edge 76 with a plurality of threaded holes 78 drilled and tapped therein. As shown in FIGS. 4-6, threaded rods 80 are disposed within threaded holes 78.

Mounting flange 64 and anchor flange 66 have threaded adjusting pins 82 and 84 disposed therethrough. As seen in FIGS. 5 and 6, threaded adjusting pins 82 are disposed through mounting flange 64 from mounting side 70 to beam side 72. Threaded adjusting pins 84 are disposed through anchor flange 66 from exterior side 86 to support side 88. Threaded adjusting pins 82 and 84 are adapted to provide leveling for anchor channel 60. Adjusting pins 82 and 84 are preferably adjustable set screws.

Clamping bracket 62 includes support flange 90 and securing block 92. Support flange 90 is adapted to support clamping bracket 62 on one of the parallel flanges 96 of beam 18, as shown in FIG. 3. Securing block 92 has holes 94 disposed therethrough. Holes 94 are compatible with threaded holes 78, and are adapted to receive threaded rods 80 therethrough. Securing devices 98 are used to secure clamping bracket 62, anchor channel 60 and threaded rods 80 to each other.

A method for extracting natural gas from well 12 under a low or negative pressure condition uses pump 30 to extract natural gas from well 12 by drawing a vacuum on well 12. Pump 30 is able to create a vacuum on well 12 by harnessing the motion of walking beam 18 pivoting about Samson post 22, which drives piston 36 of pump 30. The up and down motion of walking beam 18 provides for the stroke of piston 36 in and out of pump 30.

Pump 30 directs the extracted natural gas to volume tank 46 via gas output line 48. The natural gas in volume tank 46 is made available to prime mover 16.

In another embodiment, the invention provides for the method of installing adjustable bracket 34 on walking beam 18 of pump jack 14. In a first step, adjustable bracket 34 is in an open position, and is placed on walking beam 18 with mounting fixture 74 oriented in a downward direction. A second step connects one of lug mounts 32 of pump 30 to mounting fixture 74, and the other lug mount 32 of pump 30 to sliding bracket 38. Adjustable bracket 34 and sliding bracket 38 are each moved, together or independently, to position pump 30 for a full stroke of piston 36. One step to position pump 30 is for walking beam 18 to be positioned in a raised position thereby allowing piston 36 to be fully extended during the placement of adjustable bracket 34 on walking beam 18. Another step is to secure adjustable bracket 34 to walking beam 18, and to secure sliding bracket 38 to Samson Post 22 when piston 36 is in a compressed state with walking beam 18 in a down position.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. An apparatus for providing natural gas to a prime mover for driving a pump jack having a walking beam and a Samson post, the apparatus comprising:

a pump having a body and a pair of ends, wherein one end is attached to the walking beam and another end is attached to the Samson post, wherein the body is positioned between the walking beam and Samson post; and a tank for receiving natural gas from a natural gas well, wherein natural gas is communicated from the tank to the prime mover by the pump in response to the walking beam pivoting on the Samson post.

2. The apparatus of claim 1, wherein the pump extracts natural gas from the natural gas well and communicates the gas to the tank.

3. The apparatus of claim 1, further comprising:

a gas conduit connected to the tank and in fluid communication with a pipeline for delivering natural gas to a gas supply line; and a pressure relief valve, wherein the pressure relief valve will allow flow from the tank to the pipeline when pressure in the tank reaches a predetermined maximum level, the pressure relief valve adapted to prevent natural gas flow in the opposite direction.

4. An apparatus to communicate natural gas to a prime mover for driving a pump jack having a walking beam and a Samson post, the apparatus comprising:

a pump for extracting natural gas from a well, the pump having a body, a piston, and a pair of ends, wherein an end of the piston defines one end of the pump, the piston is adapted to provide compression of extracted natural gas, wherein one end of the pump is attached to the walking beam with a pivotal mounting fixture and another end is attached to the Samson post, wherein the body is positioned between the walking beam and Samson post; and a volume tank, wherein the volume tank receives natural gas communicated from the pump and the volume tank communicates natural gas to the prime mover in response to the walking beam pivoting on the Samson post.

5. The apparatus of claim 4, wherein the pump is adapted to create a vacuum on a gas line connected to the well.

6. The apparatus of claim 4, wherein the volume tank further comprises a pressure relief valve, the pressure relief valve being adapted to open to allow natural gas to be communicated from the volume tank to a gas supply line when the pressure in the volume tank reaches a predetermined maximum level.

7. The apparatus of claim 6, wherein the gas supply line communicates natural gas from the volume tank to a gas sales line.

8. The apparatus of claim 4, further comprising a pump bracket, the pump bracket having the pivotal mounting fixture and being adapted to be connected to the walking beam and slidably adjusted to maximize a stroke length of the piston.

9. A method of operating a pump jack comprising:

extracting natural gas from a well under vacuum conditions;

communicating natural gas to a tank using a pump having a body and a pair of ends, wherein one end is attached to a walking beam and another end is attached to a Samson post, wherein the body is positioned between the walking beam and the Samson post of the pump jack;

communicating natural gas from the tank to a prime mover;

replenishing natural gas in the tank, wherein the replenishing step provides more natural gas to the tank than is consumed by the prime mover during operations; and driving the pump jack with the prime mover.

10. The method of claim 9, further comprising a step of installing the pump on the pump jack prior to initiating the extracting step, the pump being in fluid communication with the tank.

11. The method of claim 10, wherein the extracting step comprises using an up and down motion of the pump jack to create the vacuum in the pump thereby drawing the vacuum on the well.

12. The method of claim 9, further comprising a step of providing the tank with a starting volume of natural gas.

13. The method of claim 12, wherein the providing step involves providing natural gas at a sufficient volume to operate the prime mover through startup, warm-up and for a period of time.

14. The method of claim 12, wherein the providing step involves providing natural gas at a sufficient volume to operate the prime mover through startup and warm-up until natural gas in the volume tank is replenished.

15. The method of claim 9, further comprising a step of communicating an excess of natural gas to a gas supply line when a pressure in the tank exceeds the pressure set for a pressure relief valve.

16. An apparatus for providing natural gas to a prime mover for driving a pump jack, the apparatus comprising:

a pump fluidly connected to a wellhead, the wellhead secured to a well, wherein the well is separately subjected to a vacuum condition, the well being a natural gas well;

a tank for receiving natural gas from the pump, wherein natural gas is communicated from the tank to the prime mover, the pump providing more natural gas to the tank than is consumed by the prime mover during operations;

a gas conduit connected to the tank and in fluid communication with a pipeline for delivering natural gas to a gas supply line; and a pressure relief valve, wherein the pressure relief valve will allow flow from the tank to the pipeline when pressure in the tank reaches a predetermined maximum level, the pressure relief valve adapted to prevent natural gas flow in the opposite direction.

17. A method of operating a pump jack comprising:

operating a prime mover through startup and warm-up using natural gas communicated from a tank;

driving a pump jack with the prime mover;

driving a compressor with the pump jack;

creating a vacuum on a natural gas well with the compressor, the compressor being in communication with a gas supply line and the tank;

using the compressor to communicate natural gas to the tank from either the well or the supply line;

replenishing the natural gas in the tank, wherein the replenishing step comprises providing more natural gas to the tank than is consumed by the prime mover during post-warm-up operations; and communicating excess natural gas to the gas supply line when a pressure in the tank exceeds the pressure set for a pressure relief valve.

* * * * *